US010619511B2

(12) United States Patent
Bunel et al.

(10) Patent No.: US 10,619,511 B2
(45) Date of Patent: Apr. 14, 2020

(54) DEVICE FOR ATTACHING MANIFOLDS FOR COOLING THE CASING OF A TURBINE-ENGINE TURBINE BY AIR JETS

(71) Applicant: SAFRAN AIRCRAFT ENGINES, Paris (FR)

(72) Inventors: Jacques Marcel Arthur Bunel, Moissy-Cramayel (FR); Emeric D'Herbigny, Moissy-Cramayel (FR); Alain Paul Madec, Moissy-Cramayel (FR); Pierre Tincelin, Moissy-Cramayel (FR); Benjamin Villenave, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 118 days.

(21) Appl. No.: 15/755,525

(22) PCT Filed: Aug. 25, 2016

(86) PCT No.: PCT/FR2016/052120
§ 371 (c)(1),
(2) Date: Feb. 26, 2018

(87) PCT Pub. No.: WO2017/032952
PCT Pub. Date: Mar. 2, 2017

(65) Prior Publication Data

US 2018/0216488 A1 Aug. 2, 2018

(30) Foreign Application Priority Data

Aug. 27, 2015 (FR) ..... 15 57978

(51) Int. Cl.
*F01D 25/12* (2006.01)

(52) U.S. Cl.
CPC ..... *F01D 25/12* (2013.01); *F05D 2220/3215* (2013.01); *F05D 2240/90* (2013.01); *F05D 2260/201* (2013.01)

(58) Field of Classification Search
CPC ..... F01D 25/12; F01D 25/28; F01D 11/24; F05D 2220/3215; F05D 2240/90;
(Continued)

(56) References Cited

U.S. PATENT DOCUMENTS 5,271,588 A 12/1993 Doyle
5,540,547 A 7/1996 Cole
(Continued)

FOREIGN PATENT DOCUMENTS

WO 20131186757 A2 12/2013

OTHER PUBLICATIONS

Preliminary Research Report received for French Application No. 1557978, dated Apr. 29, 2016, 3 pages (1 page of French Translation Cover Sheet and 2 pages of original document).
(Continued)

*Primary Examiner* — Kenneth J Hansen
*Assistant Examiner* — Justin A Pruitt
(74) *Attorney, Agent, or Firm* — Womble Bond Dickinson (US) LLP

(57) ABSTRACT

A device for attaching manifolds for cooling the casing of a preferably low-pressure turbine of a turbine engine by air jets. The device includes a mounting for the manifolds, shaped such as to keep the manifolds spaced apart from one another. A plurality of elements support the manifold mounting, each supporting element being attached to the casing, and connected to the manifold mounting by a connector. The device includes N cooling manifolds and N-1 supporting elements, each supporting element being arranged between two adjacent cooling manifolds.

8 Claims, 3 Drawing Sheets

(58) Field of Classification Search
CPC ..... F05D 2260/201; F05D 2260/30; F05D 2260/31; F16L 3/22; F16L 3/221
USPC ..... 415/173.1, 213.1; 248/68.1, 74.4
See application file for complete search history.

(56) References Cited

U.S. PATENT DOCUMENTS

| | | | | |
|---|---|---|---|---|
| 6,783,101 | B2 * | 8/2004 | Knotts | F16L 3/2235 211/60.1 |
| 9,869,196 | B2 * | 1/2018 | Day | F01D 11/24 |
| 2013/0048826 | A1 * | 2/2013 | Go | E02F 9/2275 248/560 |
| 2014/0030066 | A1 | 1/2014 | Schimmels et al. | |

OTHER PUBLICATIONS

International Search Report and Written Opinion received for PCT Patent Application No. PCT/FR2016/052120, dated Dec. 1, 2016, 12 pages (6 pages of English Translation and 6 pages of Original Document).
International Preliminary Report on Patentability received for PCT Patent Application No. PCT/FR2016/052120, dated Mar. 8, 2018, 11 pages (5 pages of English Translation and 6 pages of Original Document).

* cited by examiner

DEVICE FOR ATTACHING MANIFOLDS FOR COOLING THE CASING OF A TURBINE-ENGINE TURBINE BY AIR JETS

GENERAL TECHNICAL FIELD

The invention is situated in the field of turbine casing cooling, particularly of a low-pressure turbine of a turbine engine.

The present invention relates more precisely to a device for attaching manifolds for cooling the casing of a turbine of a turbine engine using air jets.

The invention also relates to a turbine engine equipped with such a device.

PRIOR ART

Figure 1:
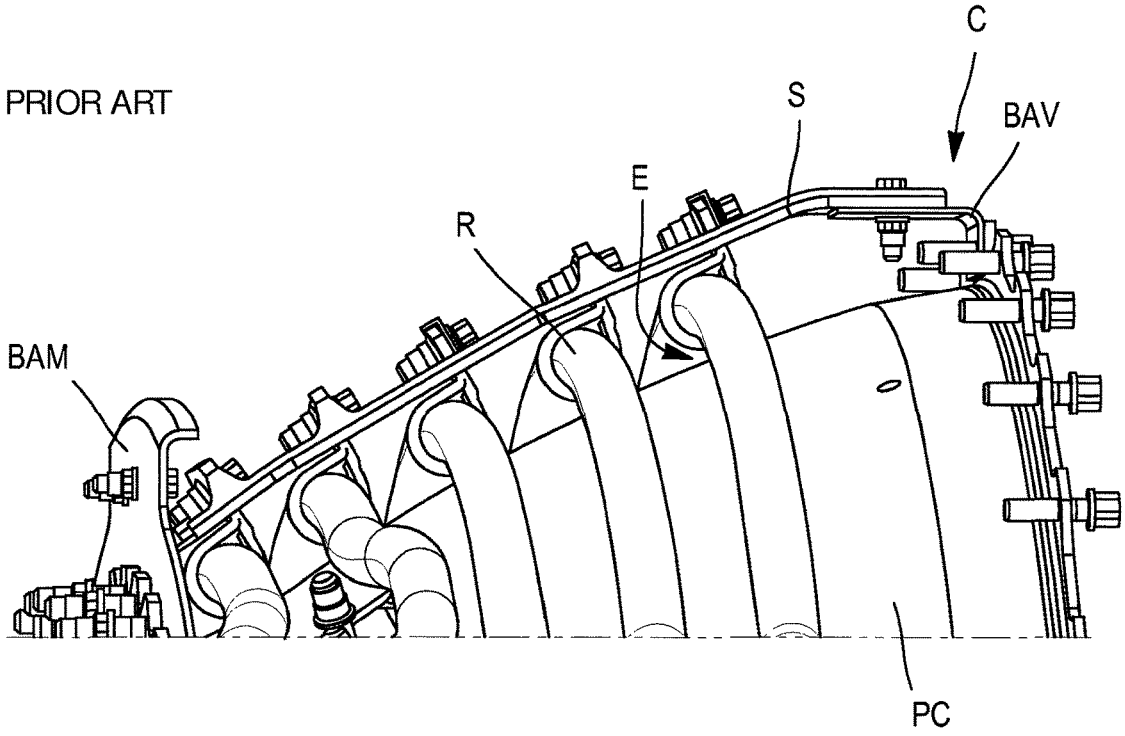
Figure 2:
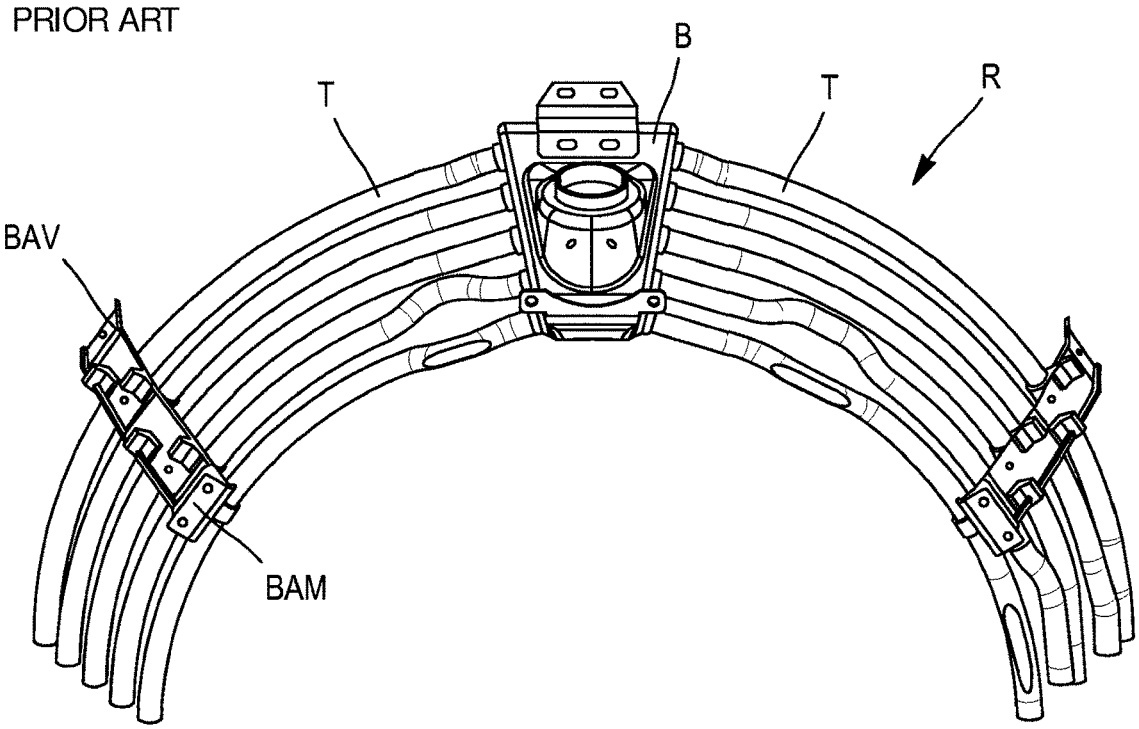

As can be seen in the appended FIGS. 1 and 2, which show the prior art, the low-pressure turbine of a turbine engine is protected by a casing C with a generally flared substantially frustoconical shape. This casing is cooled by using the technology of cooling by impingement.

The casing C is equipped with one or more housing(s) B for supplying air under pressure, connected to several cooling manifolds R.

In the embodiment shown in the figures, the casing C is equipped with two housings B, positioned at approximately 180° from one another (only one being visible in FIG. 2). Each housing B is equipped with five manifolds R, with two tubes T per manifold, each tube extending for approximately 90°. The tubes T are pierced with a series of small openings leading vertically above the exterior surface of the casing. The air under pressure transiting through these openings provides for ventilation by impingement of the casing C.

In FIG. 1, it can be seen that the supports S of the cooling manifolds R are attached to the casing by an upstream flange BAM and by a downstream flange BAV. Although this is not shown, the housings B are attached to the casing in the same manner.

In the cold state, that is when the turbines are stopped, the air gap E between an air outlet opening provided in a tube T and the exterior surface of the casing C (or "casing skin" PC) is on the order of 5 to 6 mm.

In the hot state, that is during the operation of the turbines, the metal casing C tends to dilate radially, but especially longitudinally. But the upstream BAM and downstream BAV flanges remain colder and do not dilate in the same manner as the casing skin PC. It follows that the cooling manifolds R have a tendency to move closer and even to touch the casing skin PC in some places. Although the air gap E is considerable in the cold state, it proves to be insufficient in the hot state.

It is difficult to anticipate the dilation of the casing skin PC with respect to the upstream and downstream flanges. In fact, for cooling by impingement of air jets to be effective, the manifold must be situated very near the casing skin PC and therefore maintain a constant air gap E. The positioning of the manifold in the hot state is therefore not correct, and the ramp risks being either too far or too near (or even in contact with) the casing skin, during operation of the turbines. It is consequently necessary to find attachment means allowing a constant air gap to be maintained regardless of the temperature.

Already known according to document US 2014/0030066 is a device for cooling the wall of a casing of a gas turbine using air jets. This device comprises several cooling manifolds mounted on an air distributor which holds them spaced from one another. This air distributor is itself connected to the casing, but by flanges 300, 302 attached to the ends of the casing, so that the ramps situated in its median portion risk finding themselves nearer to the casing in the event of its dilation.

PRESENTATION OF THE INVENTION

The invention therefore has as its aim to resolve the aforementioned disadvantages of the prior art.

In particular, the invention has as its objective to supply a device for attaching manifolds for cooling the casing of a turbine of a turbine engine using air jets, which avoids the variations of air gap between said manifolds and the exterior wall of the casing, even in the hot state, that is during use of the turbine.

To this end, the invention relates to a device for attaching manifolds for cooling the casing of a turbine, preferably a low-pressure turbine, of a turbine engine using air jets, comprising a support of said manifolds, shaped to hold said manifolds spaced with respect to one another and several support elements of said manifold support, each support element being attached to said casing and connected to said manifold support by connecting means.

In conformity with the invention, the device comprises N cooling manifolds and N−1 support elements, each support element being disposed between two contiguous cooling manifolds.

Thanks to these features of the invention, the air gap between the manifolds and the exterior wall of the casing remains constant, this even during use under hot conditions. In fact, the support elements integral with the manifold support are disposed between contiguous cooling manifolds and maintain these at a constant distance from the skin of the casing. In addition, these support elements being attached to the casing, they are subjected to the same variations of temperature as the casing and dilate following its deformations.

The air gap being kept constant, the cooling of the casing of the turbine is improved and the lifetime thereof is increased.

According to other advantageous and non-limiting features of the invention, taken alone or in combination:

- said manifold support comprises two blades so-called "interior blade" and "exterior blade", each one of which comprises a series of parallel grooves, separated by a planar area, each groove being shaped to surround a portion of the circumference of one of said manifolds, preferably half, the interior blade and the exterior blade being assembled on either side of the cooling manifolds, so that their respective grooves are facing one another and surround said manifolds;
- at least some of the connecting means are so-called "fixed" means, which do not allow relative movement between said manifold support and a support element;
- at least some of the connecting means are so-called "moving" means, which allow relative movement between said manifold support and a support element;
- the support element is pierced with a circular opening, the planar areas of the blades of the manifold support are pierced with a circular opening and the support element and the two blades are assembled by a screw passing through the two circular openings and cooperating with a nut, the circular openings, the screw and the nut constituting said fixed connecting means;
- the support element is pierced with a circular opening, the planar areas of the blades of the manifold support are pierced with an oblong opening and the support element and the two blades are assembled by a shoulder pin passing through the circular opening and the two oblong openings and cooperating with a washer, the assembly being accomplished so as to allow the axial sliding of said blades with respect to the shoulder pin at the oblong openings so as to accomplish a moving connection;

the support element is a saddle, attached at its two ends to the casing and the protruding central portion whereof is connected to said manifold support.

The invention also relates to a turbine engine which comprises a device for attaching said cooling manifolds as previously mentioned.

PRESENTATION OF THE FIGURES

Other features and advantages of the invention will appear from the description which will now be given, with reference to the appended drawings which represent, by way of indication and without limitation, two possible embodiments of it.

Figure 5:
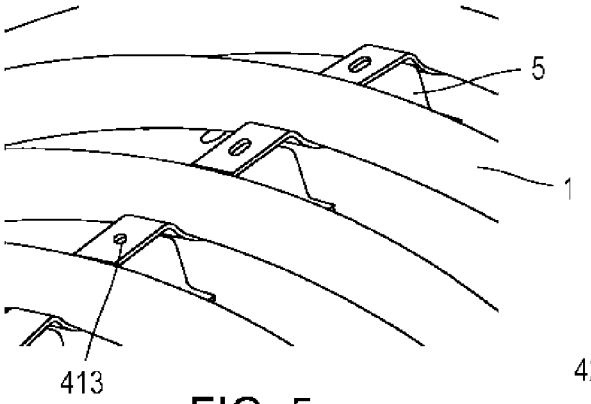
Figure 6:
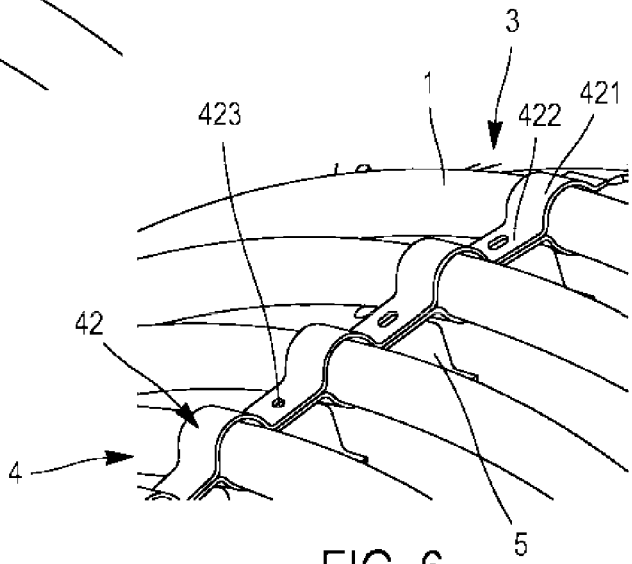
Figure 7:
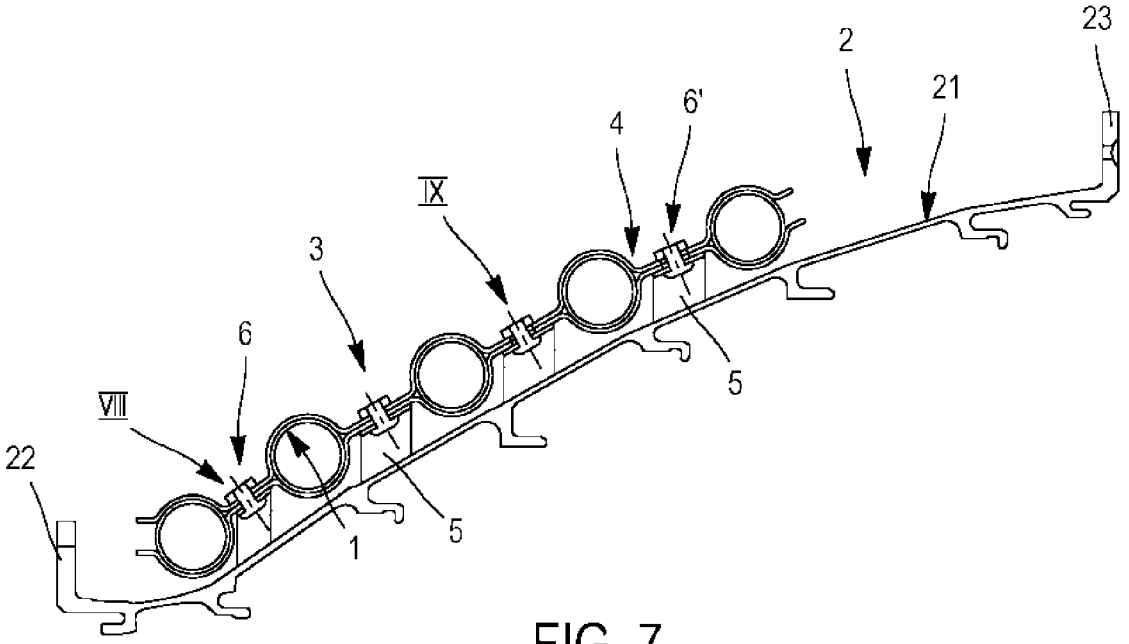
Figure 8:
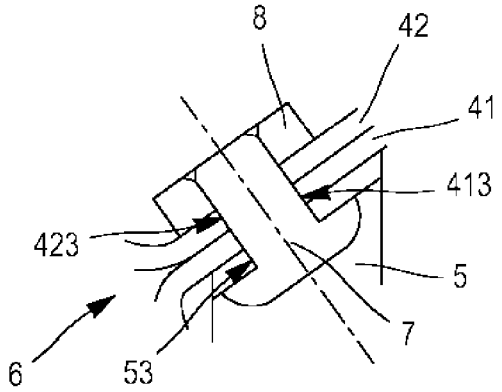
Figure 9:
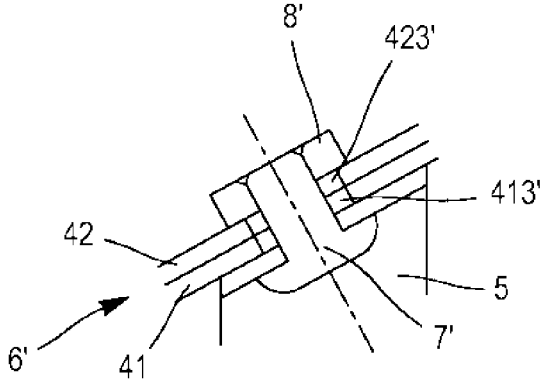

In these drawings:

FIG. 1 is a perspective view of a portion of the casing of a turbine of a turbine engine, equipped with cooling manifolds according to the prior art, FIG. 2 is a perspective view of an air supply housing and of cooling manifolds according to the prior art, FIGS. 3 to 6 are perspective views showing two embodiments of the different elements constituting the attachment device of the cooling manifolds conforming to the invention, FIG. 7 is a cross-section view of the device conforming to the invention showing two embodiments, FIGS. 8 and 9 are detail views of the zones referenced VIII and IX in FIG. 7.

DETAILED DESCRIPTION

The device for attaching the cooling manifolds conforming to the invention will now be described in connection with FIGS. 3 to 7.

It allows the attachment of cooling manifolds 1 to the casing 2 of a turbine, preferably a low-pressure turbine, of a turbine engine. The cooling manifolds 1 and the casing 2 have the same shapes and structures as those described previously in connection with FIGS. 1 and 2 for the prior art.

In other words, the cooling ramps 1 are formed from tubes with preferably circular cross-sections and having a shape curved in a circular arc, conforming to the exterior shape of the casing 2. The latter has a flared shape and comprises an exterior surface 21, an upstream end 22 and a downstream end 23.

The attachment device has the general reference symbol 3. It comprises a support 4 for said ramps 1 and several support elements 5 of said support 4.

One possible embodiment of the manifold support 4 will now be described.

This support 4 comprises two blades, respectively called the interior blade 41 and the exterior blade 42.

Figure 4:
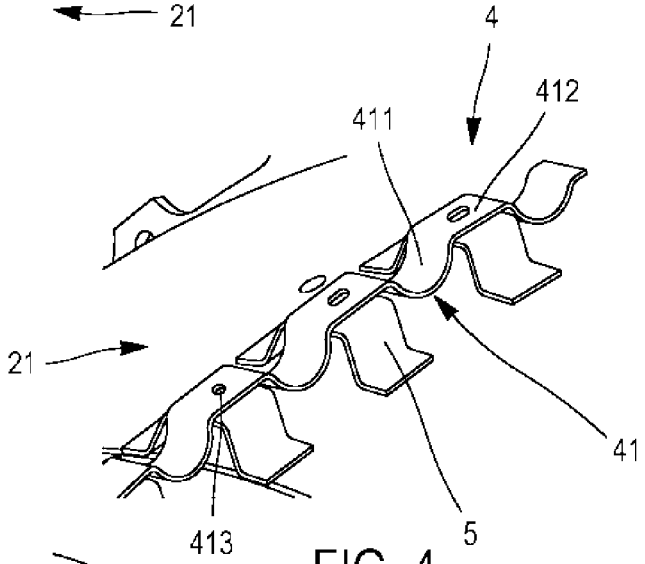

As can be seen better in FIG. 4, the interior blade 41 is designed to be disposed in proximity to the exterior surface 21 of the casing; it comprises a series of parallel grooves 411, perpendicular to the blade and separated from one another by an intermediate planar area 412.

Each groove 411 is formed to surround at least a portion of the circumference of one of said manifolds 1. In other words, in the case where the tube of a cooling manifold is of circular cross-section, the inner radius of the groove 411 corresponds substantially to the outer radius of a cooling manifold 1. Preferably, each groove surrounds half of the circumference of a manifold.

Similarly, the exterior blade 42, designed to be disposed at the exterior of the manifolds 1, also has a series of parallel grooves 421, spaced from one another by a planar area 422, (see FIG. 1).

The interior blade 41 and the exterior blade 42 are assembled on either side of the cooling manifolds 1, so that their respective grooves 411, 412 are facing one another and surround said manifolds, as can be seen in FIGS. 6 and 7.

The manifold support 4 thus allows the manifolds 1 to be held spaced from one another in the axial direction of the casing 2.

Figure 3:
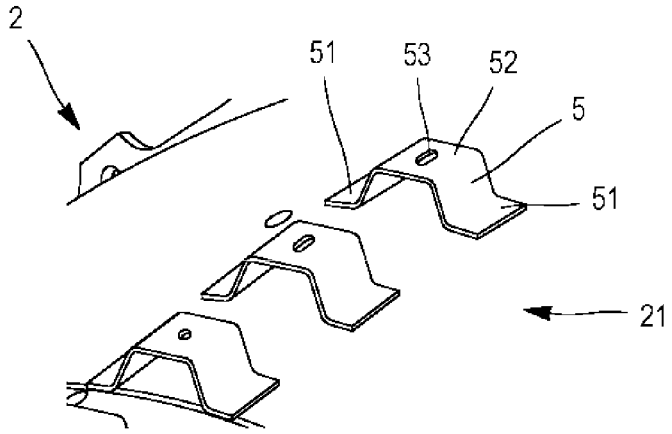

According to one possible embodiment, the support element 5 has the shape of a saddle, as can be seen in FIG. 3. Each saddle comprises two ends 51 and a protruding central portion 52.

The ends 51 are attached to the casing 2, more precisely on its exterior surface 21 (also known by the term "skin of the casing"), more precisely still on the portion of the exterior surface 21 which extends between the upstream 22 and downstream 23 ends. This attachment is accomplished by any appropriate means, for example by welding, brazing, gluing, riveting or bolting.

These support elements 5 therefore follow the deformation of the casing 2 due to its dilation, both in the radial plane and in the axial plane.

This was not the case in the state of the art described in document US 2014/0030066 where the air distributor which supports the cooling manifolds is attached by flanges, themselves attached in their turn to the two ends of the casing, hence in a region where dilation is less than in the central portion of the casing.

Each support element 5 is connected to the support 4, that is to the two blades 41 and 42, by connecting means so-called "fixed" 6 or "moving" 6' means.

The central portion 52 of the saddles is pierced with a circular opening 53.

The assembly of the different elements constituting the attachment device 3 is accomplished as follows.

As shown in FIG. 3, the different support elements 5 are attached to the casing 2. The interior blade 41 is attached to these support elements 5, so that its planar areas 412 are positioned facing the central planar protruding portion 52 of the saddle 5 (see FIG. 4).

Thereafter, and as shown in FIG. 5, the manifolds 1 are disposed in the grooves 411.

Finally, as can be seen in FIG. 6, the exterior blade 42 is positioned on the manifolds 1, so that the grooves 421 surround the manifolds 1 and the planar areas 422 are positioned facing the planar areas 412 of the interior blade 41.

In conformity with the invention, and as shown for example in FIG. 4, if the cooling manifolds 1 are N in number, then the support elements 5 in conformity with the invention are N−1 in number and are disposed between the two cooling manifolds 1 of each pair of manifolds.

Thus, the air gap between each cooling manifold 1 and the exterior surface of the casing 2 is held constant.

At least one additional support element 5 can further be provided at least at one of the two ends of the manifold support 4.

The connecting means 6 are said to be "fixed" in the sense that they do not allow any relative movement between the manifold support 4 and a support element 5. This solution is shown in FIG. 8 and in the lower left corner of FIGS. 4 to 7.

In this case, the planar areas 412, 422 of the blades 41, respectively 42, are pierced with a circular opening 413, respectively 423.

The two blades 41 and 42 and the saddle 5 are assembled using a screw 7 passing through said openings 53, 413 and 423 and a nut 8 screwed onto the screw. The screw 7 being circular and the openings 413 and 423 likewise, and of the same diameter, there exists no possibility of a relative movement of the blades of the support 4 with respect to the elements 5 of this support.

However, this fixed connection allows the support elements 5 to follow the radial dilation movement of the casing.

The collection means 6' are so-called "moving" means in the sense that they allow a relative movement between the manifold support 4 blades 41, 42 and a support element 5. In this case, and as shown in the right central and upper portions of FIGS. 4 to 7 and in FIG. 9, the openings provided in the blades 41 and 42 are oblong and are respectively referenced 413' and 423'.

The mounting is carried out with a shoulder pin 7' and a washer 8'. However, in this case, the blades 41 and 42 can slide axially with respect to the shoulder pin 7', so that the blades 41 and 42 can follow the dilation movement of the casing 2, particularly its axial dilation movement.

It will be noted that, preferably, the fixed connecting means 6 are used in proximity to the upstream end of the casing and the moving connecting means 6' at the center and in proximity to the downstream end of the casing.

However, it is possible to use exclusively one or the other of said connecting means.

The invention claimed is:

1. A device for attaching cooling manifolds for cooling a casing of a turbine of a turbine engine by using air jets, said device comprising a manifold support and a plurality of support elements for said manifold support, the manifold support being shaped to hold said cooling manifolds spaced from one another, each support element being attached to said casing and connected to said manifold support by a connecting means, wherein said manifold support includes an interior blade and an exterior blade, each one of which has a series of parallel grooves, separated by a planar area, each groove being shaped to surround a portion of the circumference of one of said cooling manifolds, the interior blade and the exterior blade being assembled on either side of the cooling manifolds, so that their respective grooves are facing one another and surround said cooling manifolds, wherein said device comprises N cooling manifolds and N-1 support elements, each support element being disposed between two adjacent cooling manifolds and wherein the connecting means of at least two of the plurality of support elements allow relative movement between said manifold support and one of said support elements.

2. The device according to claim 1, wherein at least one of the support elements is pierced with a circular opening, wherein the planar areas of the blades of the manifold support are pierced with an oblong opening and wherein the at least one support element and the two blades are assembled by a shoulder pin passing through the circular opening and the two oblong openings and cooperating with a washer, the blades and shoulder pin allowing axial sliding of said blades with respect to the shoulder pin at the oblong openings to accomplish a moving connection.

3. The device according to claim 1, wherein at least one of the support elements is a U-shaped structure, two ends of said U-shaped structure being attached to the casing and the protruding central portion of said U-shaped structure being connected to said manifold support.

4. A turbine engine comprising a turbine, wherein said turbine comprises the device for attaching said cooling manifolds according to claim 1.

5. The device according to claim 1, wherein all the connecting means allow relative movement between said manifold support and a support element.

6. The device according to claim 1, wherein the turbine is a low-pressure turbine.

7. The device according to claim 1, wherein the grooves of the interior blade and the grooves of the exterior blade are each shaped to surround half of the circumference of one of said manifolds.

8. The turbine engine defined by claim 4, wherein said turbine is a low-pressure turbine.

* * * * *